United States Patent [19]

Hewett

[11] 4,046,321

[45] Sept. 6, 1977

[54] HIGH PRESSURE SPRAY CLEANING HEAD

[75] Inventor: Charley L. Hewett, Northglenn, Colo.

[73] Assignee: Kem-O-Kleen, Inc., Englewood, Colo.

[21] Appl. No.: 708,721

[22] Filed: July 26, 1976

Related U.S. Application Data

[62] Division of Ser. No. 564,858, April 3, 1975, Pat. No. 3,997,114.

[51] Int. Cl.[2] ..... B05B 7/08

[52] U.S. Cl. ..... 239/420; 239/434

[58] Field of Search ..... 239/318, 418, 511, 127, 239/510, 420, 434

[56] References Cited

U.S. PATENT DOCUMENTS

| | | | |
|---|---|---|---|
| 357,799 | 2/1887 | Wainwright | 239/511 |
| 1,510,175 | 9/1924 | Kinnear | 239/510 X |
| 2,940,673 | 6/1960 | Budwig | 239/318 X |
| 2,948,480 | 8/1960 | Budwig | 239/418 |
| 3,027,097 | 3/1962 | Gleason et al. | 239/318 |
| 3,050,261 | 8/1962 | Littlefield | 239/418 X |
| 3,380,658 | 4/1968 | Stasz et al. | 239/127 X |
| 3,820,717 | 6/1974 | Pohle | 239/511 X |

*Primary Examiner*—Evon C. Blunk
*Assistant Examiner*—Michael Mar
*Attorney, Agent, or Firm*—Ancel W. Lewis, Jr.

[57] ABSTRACT

In a high pressure spray cleaning apparatus and method there is provided separate pressurized flow circuits to separate inlets of a spray head. A chemical flow circuit delivers a cleaning chemical fluid under pressure and a carrier flow circuit delivers a heated carrier fluid, preferably water and or soap, under a relatively high pressure. The pressurized cleaning chemical fluid and heated water are intimately mixed and distributed by a novel spray head. A power-driven air compressor is coupled to a chemical storage tank containing a cleaning chemical in the chemical flow circuit. A power-driven positive displacement pump associated with a by-pass unloader valve regulates the pressure of the water from a water tank delivered to a heating coil in which the water is heated in the carrier flow circuit. When the heated water is not being sprayed at the spray head, it is automatically returned by the operation of the by-pass unloader valve at a reduced pressure to the water tank. An electric control circuit controlling a heating unit selectively heats the heating coil during certain operating conditions and automatically stops the heating of the coil under other conditions. The spray head is carried on the end of a hand held wand with control valves to separately regulate flow through each circuit, the spray head having a nozzle that sprays the heated water in a fan-like pattern against a deflecting edge and cleaning chemicals are forced through an aperture into the fan-like pattern prior to its striking the deflecting edge to be intimately mixed with the heated water to produce a mixture that strikes the deflecting edge and is deflected therefrom in a highly concentrated form at a high velocity.

6 Claims, 14 Drawing Figures

HIGH PRESSURE SPRAY CLEANING HEAD

This is a division of application Ser. No. 564,858, filed Apr. 3, 1975, now U.S. Pat. No. 3,997,114.

FIELD

This invention generally relates to the mixing and spraying chemical cleaning fluids and more particularly to a novel and improved method, apparatus and spray head for pressurized spraying of chemicals that is particularly suitable for brick cleaning applications and the like.

BACKGROUND

After the construction of brick structures, it is frequently necessary to remove undesirable materials from the surface thereof including splatters of paint, efflorescence, tar and portland cement and the like as a final cleaning operation. Manual cleaning with brushes or the like requires considerable time and effort. Some attempt has heretofore been made to provide pressurized spray cleaning apparatus for this purpose, but such apparatus has encountered difficulties with corrosion of the equipment by the cleaning chemicals used, difficulties in mixing of chemicals with a water carrier or the like, and in some instances prior known practices have not developed suffficient pressure or the necessary spray pattern to be effective. Moreover, it is important in the cleaning of the bricks that the cleaning solution be carefully controlled so as not to be too strong as this condition would bleach out mortar color, deface the brick, or sand the joints, or cause discomfort to the operator. For this type of cleaning application it is important that the cleaning apparatus be fast in operation, relatively maintenance free and easy to operate.

Accordingly, it is an object of this invention to overcome many of the deficiencies in prior spray cleaning apparatus and methods and to provide a novel and improved method and apparatus for spray cleaning surfaces that is suited for a wide range of cleaning applications.

Another object of this invention is to provide a novel and improved method of cleaning a surface with a mixture of water and chemicals in a spray delivered under intensive concentrated pressure.

A further object of this invention is to provide a novel spray head that intimately mixes fluids delivered from separate supply sources.

Yet a further object of this invention is to provide a novel apparatus that is relatively maintenance free, versatile for handling a variety of fluids, easy to regulate and operate at the spray end, portable, and highly effective for cleaning splatters from brick and the like.

A further object of this invention is to provide spray cleaning apparatus that may be readily transported to and from the point of use.

Still a further object of this invention is to provide a novel apparatus that achieves comparatively high pressures and a mixture and dilution of the cleaning chemical at the spray head for cleaning bricks and the like.

Other objects, advantages and capabilities of the present invention will become more apparent as the description proceeds taken in conjunction with the accompanying drawings, in which.

SUMMARY OF THE INVENTION

Figure 1:
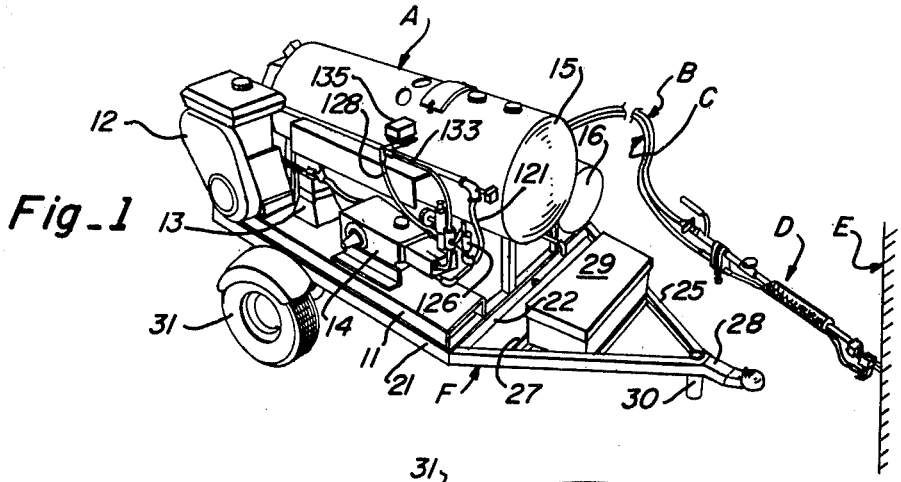
FIG. 1 is a front perspective view of high pressure chemical spray cleaning apparatus embodying features of the present invention.
Figure 2:
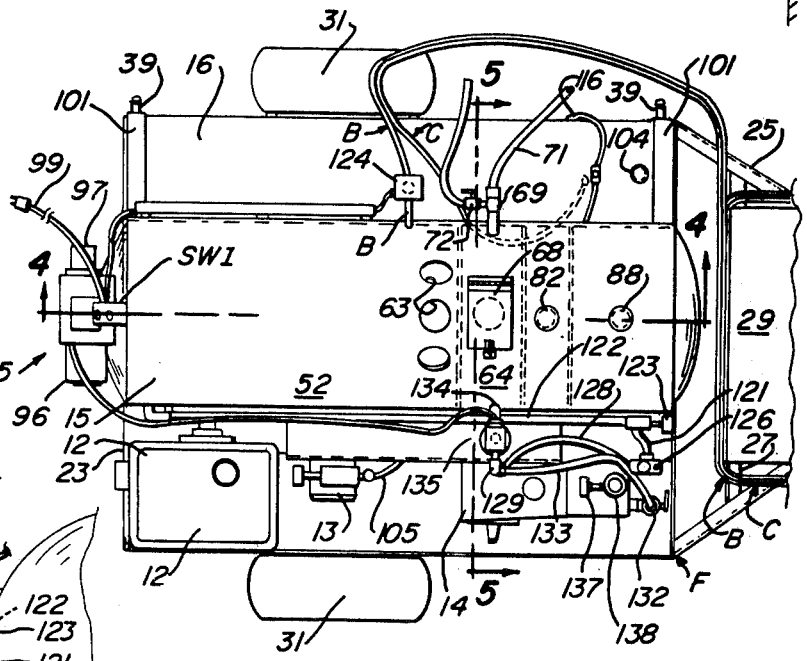
FIG. 2 is a top plan view of a portion of the apparatus of FIG. 1 with the wand assembly not shown.
Figure 3:
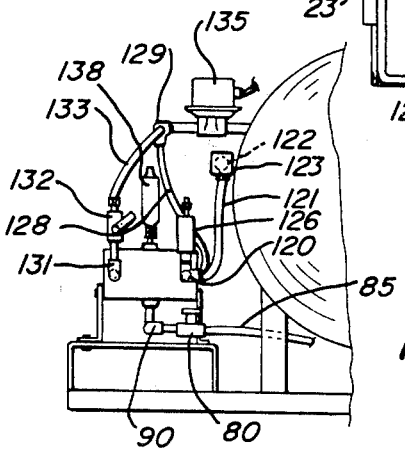
FIG. 3 is a front end view of the pump and flow line connections associated therewith.

In accordance with the present invention, in the method and apparatus shown and described herein, there is provided a separate chemical supply circuit for supplying heated water under pressure from a water storage tank and soap from a separate tank if desired. The cleaning chemicals and water and or soap are delivered to separate inlets of a spray head in such a way that there is no mixing of the chemicals except at a point of discharge at the spray head. An engine drives an air compressor coupled to a chemical storage tank containing the desired cleaning chemicals whereby the chemicals are forced by the pressure provided by the compressor from the chemical tank through a flexible flow line to a wand assembly carrying the spray head at one end. The engine also drives a positive displacement pump that pumps water from the water storage tank through a heating coil coupled by a flexible flow line to the wand assembly to supply heated water to another inlet of the spray head. A by-pass unloader valve operatively associated with the pump maintains a constant relatively high pressure in the flow line from the pump outlet to the heater coil, and when the heated water is not being sprayed returns the water to a water tank. The pump and unloader valve arrangement can deliver line pressures as high as 1600 psi and the compressor pressures up to 80 psi. An oil burner type heating unit is arranged to heat the heating coil and is regulated by a control circuit that automatically turns the heating unit on and off during certain operating conditions.

The spray head has a distributor body with an inlet that receives the pressurized chemical and has a discharge orifice in a top surface. A spray nozzle is directed toward a leading deflecting edge formed by the leading edge of the top surface and a front wall surface whereby upon the simultaneous delivery of the chemical and heated water to the spray head a mixing takes place and a concentrated spray pattern emits from the deflecting edge. The spray head is mounted on the end of a hand held wand provided with control valves to selectively regulate the delivery of the chemicals and heated water to the spray head.

Referring now to the drawings, the high pressure chemical spray cleaning apparatus shown, in general, is comprised of a supply assembly generally designated by A and coupled by separate flexible flow lines B and C to a wand assembly D that is hand held by the operator to direct a spray toward an object to be cleaned represented at E which in the application described herein is a brick wall represented at E having portland cement or the like (undesirable material) splattered thereon. The supply assembly A is shown as removably mounted on a trailer F designed for transport of assembly A to and from the point of use. It is understood, however, that transport means other than trailer F such as the box of a pickup truck may be used to transport the cleaning apparatus of the present invention. In general, the supply assembly A has a support frame 11 on which there is mounted several principal parts including at one side toward the rear a gasoline engine 12 that drives an air compressor 13 and positive displacement pump 14 that is mounted on the frame forwardly of the engine 12. A tank assembly 15 is mounted at a central position on the support frame 11 and a cleaning chemical fluid tank 16 is mounted on the support frame along the side thereof opposite the engine 12.

The trailer F shown is comprised of a generally box-shaped frame constructed and arranged so that the support frame 11 of the supply assembly A will nest therein and can be readily lifted up therefrom. The trailer frame is comprised of a pair of oppositely disposed side rail members 21, a front rail member 22, and a rear rail member 23 connected at the ends as by welding. Each rail member shown is made of angle iron and has an inturned lower leg that provides a base for the support frame 11 and an upright outer leg that holds the support frame 11 against lateral movement. Forwardly of the box-shaped frame there is a forwardly converging V-shaped draw bar 25 that is made of a pair of opposed angle iron members disposed with a flat inturned top leg and a depending outer leg together with a cross brace 27. The V-shaped draw bar 25 terminates at front end in a trailer hitch 28.

A tool box 29 is mounted on and is affixed to the V-shaped draw bar 25 and cross brace 27. The tool box 29 is arranged in spaced relation to the support frame 11 and rearwardly of the hitch 28 so that the flow lines B and C coupled to the wand assembly D can be wrapped therearound and the wand assembly D placed on the support frame inside platform 36 on suitable hooksfor transport. The flexible flow lines B and C have considerable length to facilitate the bringing of the spray head up to and immediately adjacent the surface E being cleaned. A vertically disposed tubular support 30 is mounted behind the hitch 28 and is adapted to receive a support leg (not shown) that will support the trailer is a horizontal position when the pulling vehicle is removed. The box-shaped frame is mounted on conventional axle and has a pair of ground engaging support wheels 31.

The support frame 11 of the supply assembly A is shown as comprised of a pair of opposed side members 32 having a front end member 33, an intermediate cross member 34 and a rear end member 35 connected together at the ends in a rectangular framework that is sized to slidably fit within the frame of the trailer above-described. These side, front and rear and intermediate end members are made of tubular metal stock showing as having a square cross section and are preferably welded at ends. This frame is releasably fastened to the trailer frame by bolts 19. A platform 36 is mounted on one side of the frame 11 to provide a mounting base for the engine 12, compressor 13 and pump 14. A pair of laterally spaced upright support braces 37 are connected to the front end member 33 and a pair of laterally spaced upright support braces 38 are connected to the rear end member 35 to mount the tank assembly 15 on the support frame and a pair of side supports 39 are provided to hold the chemical cleaning fluid tank on the support frame 11.

Figure 6:
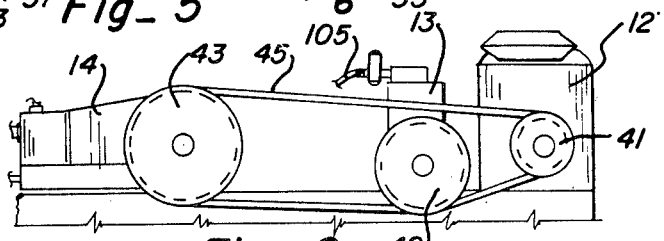
FIG. 6 is a sectional view taken along lines 6—6 of FIG. 5.

A part of the motive power for the supply assembly A is provided by the gasoline engine 12 which has an output shaft carrying a pulley 41 as best seen in FIG. 6. The air compressor 13 has a pulley 42 on its input shaft and the pump 14 has a pulley 43 on its input shaft. An endless belt 45 is trained over the engine pulley 41, the pump pulley 43 and one side of the belt 45 engages the compressor pulley 42 so that the rotary motion of the engine is simultaneously transmitted to the pump 14 and to the air compressor 13.

The tank assembly 15 is comprised of an elongated tubular body 47 arranged centrally and lengthwise of the support frame 11 having a front end cap 48 and a rear end cap 49 each with flanged portion that telescope in the opposite ends of the tubular body 47. Within the tubular body 47 there is formed at the rear end a heat exchanger section inclusive of a helical heating coil 51 comprised of a plurality of turns extending along a portion of the tubular body defining a heat exchange chamber designated 52 that is utilized to heat the water as it passes there through and is described more fully hereinafter.

At the forward end of the helical heating coil there is wound additional inside turns 53 which narrows the chamber and affords more contact of the heated air with the coil and thereby increases the heat exchange effect. An outlet end section of the heating coil designated as 54 extends in through the side wall of the tubular body 47 and is coupled to flexible flow line B. The smaller opening in the coil at the downstream end with additional inside turns 53 has an imperforate baffle plate 57 that is inset from the downstream end to close the inside of turns 53 and the downstream end of the coil is also covered by an imperforate doughnut-shaped baffle plate 58 to direct the heated air in chamber 52 around the coils. This arrangement of baffle causes the heated air to circulate around the inside turns 53 before being discharged into the exhaust chamber 61. A partition wall 59 is disposed in spaced relation to plate 58 to form the exhaust chamber 61 forwardly of the heat exchange chamber 52. Heat insulation 62 is provided inside the wall 59 and along the bottom thereof to heat insulate the heat exhaust exchange chamber 61 from other tanks of the tank assembly. Vent openings 63 are found in the top of the chamber 61 to vent heated air to the atmosphere.

Forwardly from the exhaust chamber 61 there is provided a water storage tank 64 formed between a wall 59 and another wall 65 spaced from wall 59. In the preferred embodiment described herein, the preferred carrier fluid is water and at times water mixed with relatively small quantities of soap as described hereinafter. The water tank 64 contains a float 66 to indicate fluid level and has a top opening 67 normally covered by a hinged flap cover 68. An inlet T-fitting 69 is connected into the water tank 64 with a flow line 71 shown coupled to one inlet of fitting 69 to receive tap water to fill the water tank and an auxiliary outlet line in the other inlet of fitting 69 has a control valve 72 with a flow line shown coupled thereto to facilitate the washing of the apparatus or the like. A T-fitting 73 is mounted in the bottom of the tank 64 with an outlet line 74 coupled to a drain valve 75 to drain the water tank and with the other outlet having a flow line 76 leading to the inlet of the pump 14.

An optional soap tank 78 is formed between wall 65 and a wall 79 spaced from wall 65. The soap tank has an inlet fill opening 81 defined by a tubular section normally covered by a removable cap 82. The soap tank includes a valve-controlled drain 83 in the bottom and has a discharge outlet 85 in the bottom. The soap is an optional feature for cleaning white brick or jobs with dirt, oil or atmosphere deposits from brick or the like. Wall 79 and a front end cap 48 form a fuel tank 86 having a top fill opening 87 defined by a tubular section. The fuel tank 86 has a drain outlet 89 with an outlet flow line 91 coupled thereto and an inlet flow 92 with an inlet flow line 93 coupled thereto.

Figure 9:
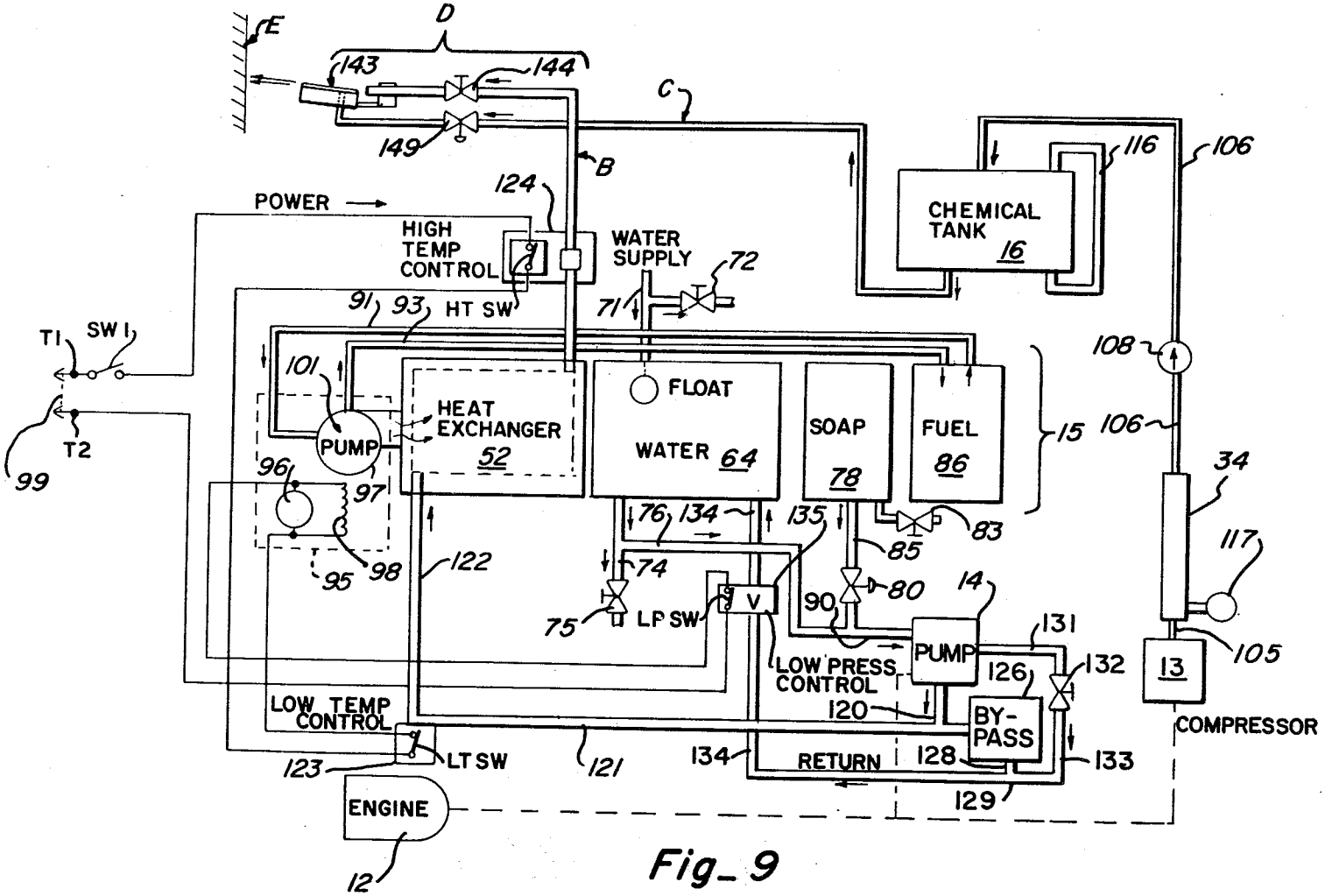
FIG. 9 is a schematic fluid flow and electric circuit diagram of the apparatus shown in FIG. 1 through 8.
Figure 10:
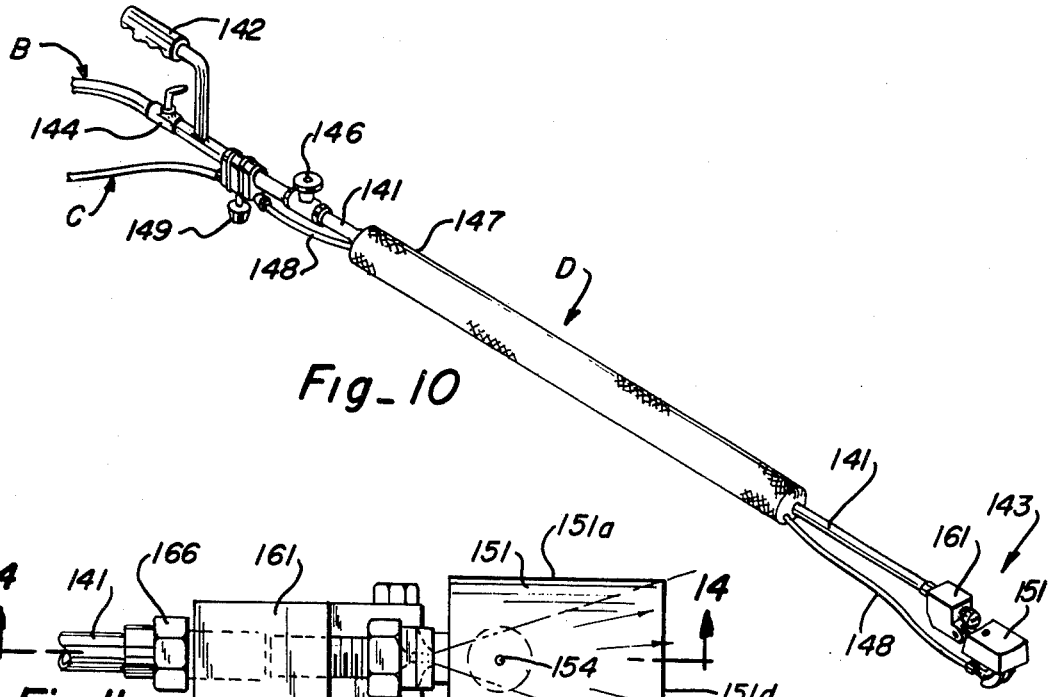
FIG. 10 is a perspective view of the wand assembly shown in FIG. 1.
Figure 11:
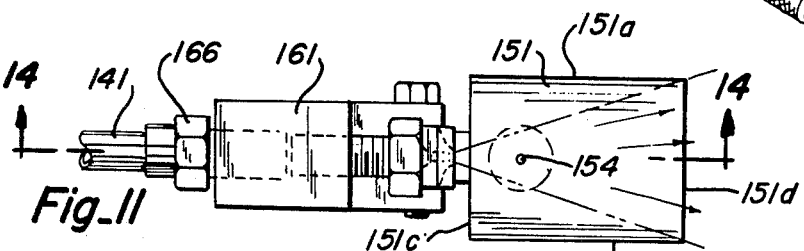
FIG. 11 is a top plan view of the spray head portion of FIG. 10.
Figure 12:
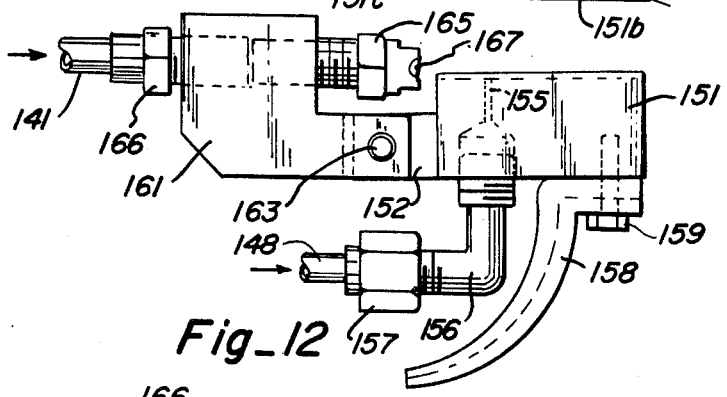
FIG. 12 is a side elevation view of the spray head.
Figure 13:
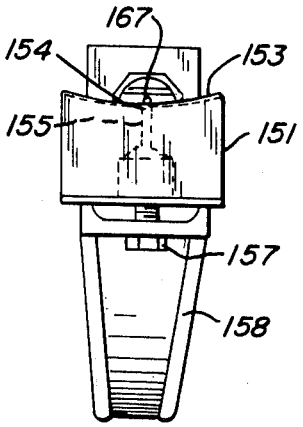
FIG. 13 is a front end elevation view of the spray head.
Figure 14:
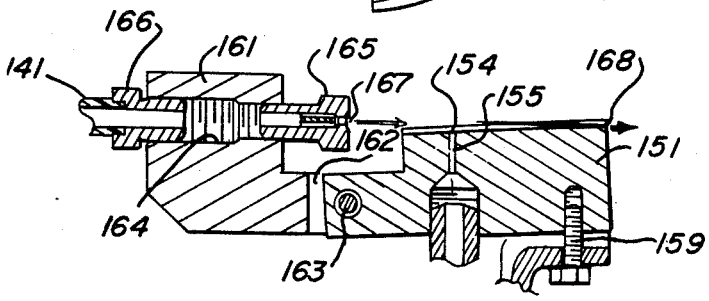
FIG. 14 is a sectional view taken along lines 14—14 of FIG. 11.

A heating unit 95 adapted for heating the coil 51 is mounted on the rear end cap 49 which is provided a central aperture to accomodate same, the heating unit being of a conventional oil burner type heating device. This heating unit 95 as best seen in FIG. 9 includes an electric motor 96 with a pump 97 coupled to the shaft of the motor, an electric burner ignition transformer 98 and an on-off electric switch SW1 that regulates the electric power to the motor 96 and associated circuits described hereinafter. An electric cord and socket 99 is used to connect AC power from a supply to this circuit. The flow line 91 is connected between the outlet of the fuel tank 86 and the fuel intake of the pump 97 to deliver fuel to the pump which forces the fuel through a spray nozzle whereupon it is ignited by a spark produced by the ignition transformer 98 which in turn heats the air in the heat exchanger chamber 52 to heat the water flowing through the heating coil 51 therein. The return flow line 93 between the fuel tank 86 and pump 97 returns excess fuel to the fuel tank 86. The fuel in tank 86 typically is kerosene.

The chemical tank 16 is generally cylindrical and is make as an integral unit preferably of a corrosion-resistant plastic material, PVC or the like. This tank has metal end rings 101 that are engaged by a bolt 102 on each of the side braces 39 to releasably hold the tank support frame 11. A fill cap 104 closes the fill opening in the top at the front end thereof. Typically the pressure in the tank is in the range of 20 to 80 psi with the average pressure being about 25 to 30 psi. A suitable chemical for cleaning bricks is muratic acid or hydrochloric acid.

The supply assembly A has two independent or separate flow circuits both of which are supplied pressure or pressurized by power produced by the running of the gasoline engine 12. The first of these flow circuits is the chemical circuit that delivers a supply of cleaning chemicals at a selected pressure to the flow line C and the second is the carrier fluid circuit that delivers a supply of pressurized, heated water and or soap to flow line B.

Figure 4:
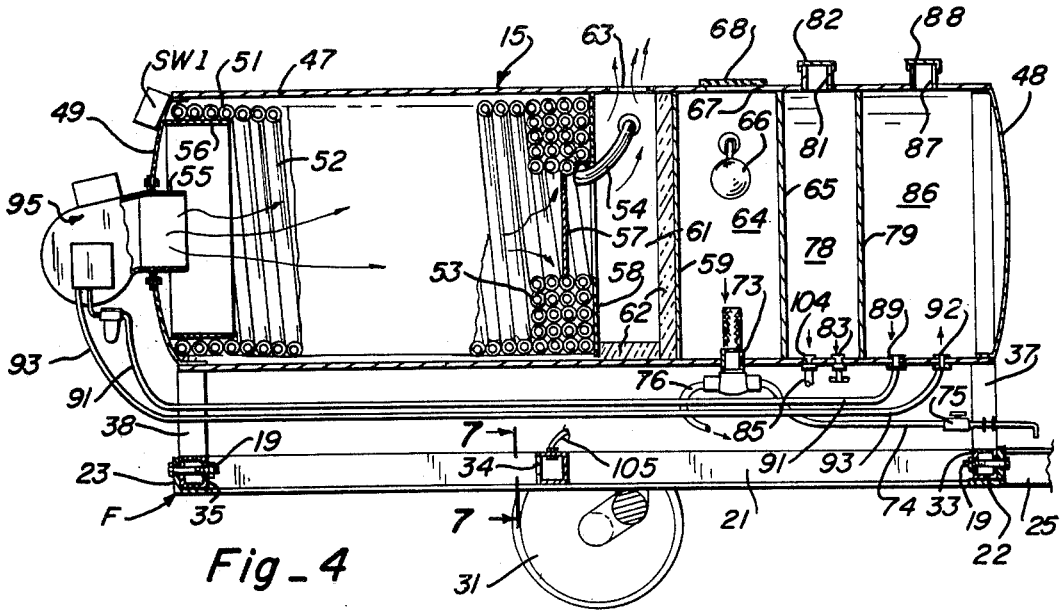
FIG. 4 is a sectional view taken along lines 4—4 of FIG. 2.
Figure 7:
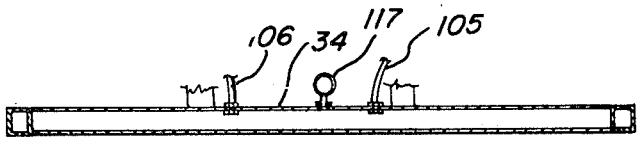
FIG. 7 is a sectional view taken along lines 7—7 of FIG. 4.
Figure 5:
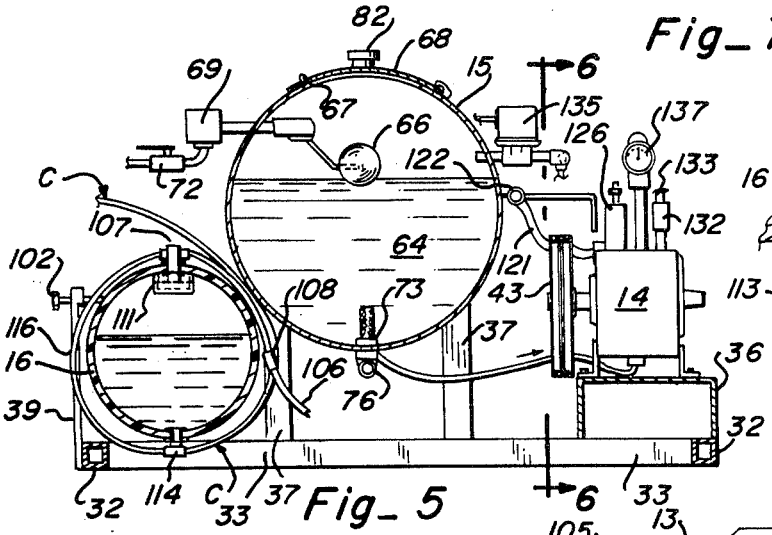
FIG. 5 is a sectional view taken along lines 5—5 of FIG. 2.
Figure 8:
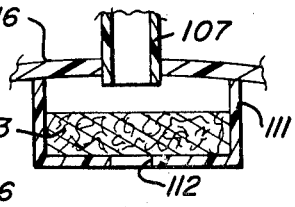
FIG. 8 is an enlarged fragmentary sectional view of the filter in the air pressure line at the inlet of the chemical tank.

In the chemical circuit the output of the compressor 13 has a flow line 105 connected to one side of the tubular intermediate cross member 34 of the frame 11, as best seen in FIG. 4. Another flow line 106 spaced from line 105 along member 34 is connected into member 34 and to one inlet of a T-fitting 107 mounted in the top of the chemical tank 16 so that the cross member 34 also functions as a pulsation dampener to remove any pulsations in the chemical fluid flow that might be caused by the compressor 13. A mono-flow valve 108 is connected in the flow line 106 to prevent loss of pressure and back flow of the chemical from the tank 16. There is further provided inside the chemical tank 16 a retaining cap 111 with a center hole 112 and a filter material 113 of felt or the like arranged to also prevent possible back flow of chemicals to the compressor 13. A T-fitting 114 in the bottom of the tank has an outlet connected to the chemical flow line C which in turn conducts chemicals from the tank to the wand assembly D. A level indicator for the chemical tank 16 is provided by a length of transparent flow line 116 coupled between the top of one side of fitting 107 and one side of bottom fitting 114. Further, a pressure gauge 117 is mounted in the frame member 34 to indicate the line pressure from the compressor 13 to the chemical tank 16.

For the heated water circuit the flow line 76 above-described conducts water from the water tank and a flow line 85 being connected to a common inlet flow line 90 to supply soap and water or water only to the inlet of the pump 14. The pump 14 has one discharge outlet with a T-coupling 120 having one outlet thereof coupled by a flexible flow line 121 to a rigid cold water pipe 122 mounted on the side of the tank assembly 15 that conducts cold water pumped by the pump 14 to the inlet side of the heating coil 51. A low temperature, flow responsive control device 123 is coupled to one end of the cold water pipe where it joins to flow line 121 to sense the temperature of the water entering the coil 51. Control device 123 has a normally closed electric contact or switch LTSW arranged in the control circuit for the heating unit described hereinafter.

A high temperature flow responsive control device 124 is connected in water line leading from the heat exchange chamber designated line B to sense the temperature of the heated water leaving the heating coil 51. This control device 124 has a normally closed electric contacts or switch designated HTSW that is also connected in the control circuit for the heating unit described hereinafter.

An inlet of a by-pass unloader valve 126 is coupled to the other outlet of coupling 120 so as to have the outlet of the pump common to the cold water line coupled to an inlet of the by-pass unloader valve. The outlet or return of the by-pass unloader valve 126 is coupled by the flow line 128 to a two-inlet coupling 129. The pump 14 has a second outlet provided with a coupling 131 connected to a cut-off valve 132 that in turn is connected to the other inlet of the coupling 129 which via a by-pass flow line 133 returns the water to the tank. A return line 134 is connected between coupling 129 and the tank. A low pressure flow responsive control device 135 is coupled between coupling 129 and return flow line 134 and has a normally closed electric contacts or switch designated LPSW connected in the control circuit for the heating unit described hereinafter. A pressure gauge 137 is shown mounted on the pump 16 and a pulsation dampener 138 is also known mounted on the pump 16.

The pump 16 is a positive displacement-type pump that uses a piston in a cylinder. The by-pass unloader valve 126 is designed for use with a positive displacement pump and functions to maintain a substantially constant line pressure in the heated water line B. When the valve in the wand controlling flow in the water line B is shut off, the by-pass unloader valve 126 opens immediately. by-passing all of the liquid flow from the water line D to the water tank via line 134 at reduced line pressure. The pressure in the hot water line B immediately becomes zero. The control device 135 senses the return flow and opens the control circuit to the motor so there is no heating when there is a return flow via line 134. When the line valve at the wand is opened allowing flow through line B the by-pass unloader valve 126 closes immediately and the system pressure returns to the higher spraying pressure. The unloader valve 126 shown has a spring adjusting screw to set the output pressure within a selected range of about 1200 to about 1600 psi and a by-pass adjusting screw to adjust the pressure in the return line which is a substantially reduced pressure.

In the electric circuit diagram shown in FIG. 9 there is provided a circuit that functions to control the electric power to the electric motor 96 and ignition transformer 98 of the heating unit. Input power terminals desginated T1 and T2 receive electric power from a suitable AC source via the cord and socket 99. Beginning at terminal T1 there is provided a series circuit including the normally open, on-off control switch SW1, the normally closed high temperature control switch HTSW, a normally closed low temperature control switch LTSW, the terminals of the electric motor 96 and ignition transformer 98 which are connected in parallel with one another to be energized simultaneously, and the terminals of the low pressure control switch LPSW which in turn is connected back to terminal T2. With the closure of the starting switch SW1 and all of the control switches in that circuit are normally closed and the motor 96 will run and the heating unit will heat the heating coil 51. However, when the temperature of the water coming out of the flow line B exceeds a selected amount such as 200° F then the high temperature control switch WTSW opens and the motor and pump stop and the transformer 98 is de-energized. Conversely, when the temperature of the water proceeding from line B cools below 220° F, HTSW closes and the motor and heater unit start to again heat the water passing through the heating coil. The low temperature control device LTSW remains closed until the temperature of the water to the heating coil raises above a selected temperature, preferably about 110° F in which case the switch opens and the power to the motor is removed. This switch LTSW is intended for use when the engine 12 stops and the burner is still running. There is a backflow of heated water through the coil 51 that serves to actuate and open LTSW and the burner motor is de-energized.

Referring now to the FIG. 10 through 14, the wand assembly D is shown to comprise a rigid water pipe 141 having a handle 142 mounted at the inlet end thereof and a spray head generally designated by numeral 143 mounted at the outlet end of pipe 141. A control valve 144 preferably of the on-off type is connected in the rigid water pipe upstream of the handle to regulate the flow of heated pressurized water in line B to the spray head 143. A discharge valve 146 is provided in the water pipe 141 downstream of the handle which will by turning on allows the discharge of fluid from the pipe upstream of the spray head and this valve can be used to flush anti-freeze through the water line B or the like. A length of tubular configured metal mesh 147 is telescoped around and in spaced relation to and secured to the water pipe to between the discharge valve 146 and the spray head 143 to provide an insulated hand grip for the user.

A length of flexible plastic tubing 148 conveys the chemical cleaning fluid from chemical flow line C to an inlet of the spray head 143. Tubing 148 is carried by the rigid pipe and extend inside the tubular mesh 147. A metering valve 149 is mounted on the water pipe forwardly of the handle and is coupled between the flow line C and the flexible line 148 to regulate the flow of cleaning chemical fluid to the spray head 143. In the usual operation, the metering valve is turned on first and the amount of chemical is observed as it emits from orifice 154. Then valve 144 is moved to the on position.

The spray head 143 functions to intimately mix the cleaning fluid and hot carrier water to emit the mixture as a fine, high velocity, highly concentrated spray that displays itself in a generally fan-like pattern. The spray head 143 is comprised of a distributor body 151 having a generally oblong shape having a pair of opposed side wall surfaces, 151*a* and 151*b,* a rear wall surface 151*c* and a front wall surface 151*d* with a rearwardly extending leg portion 152. The distributor body 151 has a top surface 153 that terminates in a leading knife-like edge 168 formed by the top surface 153 and the front face 151*d* arranged normal thereto. The top surface is slightly laterally dished or downwardly concave so that the leading edge 168 is slightly concavely curved. A chemical discharge aperture or opening 154 is centered in surface 153 between the sides and is closer to rear surface 151*c* than front surface 151*d.* A small bore hole 155 in the body forms opening 154 and hole 155 is arranged at right angles to surface 153 to emit a jet of chemical into the water spray prior to its striking edge 168. Bore hole 155 is enlarged at its inlet end and has internal threads that receive one end of a right angle fitting 156 that is coupled at its opposite end to the flexible tube 148 by means of an internally threaded coupling cap 157. In this way the cleaning fluid is conveyed upwardly through the distributor body to the discharge aperture 154. A rigid guard member 158 is fastened by a bolt 159 at the forward end of the distributor body and extends under the fitting to protect it against breakage.

A nozzle support body 161 is pivotally attached to the distributor body 151 by the provision of a forked forwardly projecting portion 162 that projects from a forward wall surface of the body 161 and slidably receives the lug portion 152 extending from the rear wall of the body 151 together with a bolt 163 that threads through a seat of opposed alined apertures in the forked portion and an aperture in the lug portion 152. There is a space left between the end of lug portion 152 and the inside of the forked portion 162 to allow for the relative pivoted movement. The nozzle support body 161 has a through bore 164 above and parallel with the forked end portion that is internally threaded to support a spray nozzle 165 at the forward end and an internally threaded fitting 166 to releasably connect the rigid water pipe 141 thereto at the inlet end. With the pivotal relation of the distributor body and nozzle support body the spray nozzle can be adjusted to a selected angle to direct the spray from the nozzle 165 toward the deflecting edge 168. The orifice 167 of the spray nozzle is positioned above the plane of the deflecting surface. As viewed from the top the spray nozzle 165 forms a fan-like spray pattern of about 15° that intersects the corners of the leading edge 168 of the distributor body formed by parallel side surfaces and the front surface thereof. The most desirable results are achieved when the top surface is turned up slightly at an angle to the axis of the nozzle so that the spray pattern intersects or strikes the leading edge 168. By using a spray pattern nozzle in which the spray is essentially planar and has a limited angle pattern and directing if off an edge 168, there is a more concentrated force provided by the mixture as it leaves body 151. In this way the fine spray is concentrated at a series of points along a line provided by the leading edge 168. The distributor body 151 is made of a chemical resistant material such as titanium or zirconium.

OPERATION

In the start up procedure for the above-described apparatus the on-off switch SW1 is set on the off position and the plug-in electric cord 99 is connected to a suitable power supply. The input water line 71 is coupled to the fitting 69 and turned on at the source. The cut-off valve 132 at the pump head is turned to the open position. The water line control valve 144 on the wand is closed. The engine 12 is then started. After the engine is running the electric switch SW1 is turned on and the cut-off valve 132 at the pump head is closed. Because all of the switches on contacts in the heating circuit are closed, the heating unit heats the coil and heated water under pressure is delivered to the water line B. When the water temperature exceeds 200° F then the motor circuit opens and the motor and burner shut off.

The operator holds the wand assembly D and directs the spray head toward the target E. The metering valve 149 is opened to emit a selected amount of chemical depending on the cleaning job and valve 144 is then moved to an open position.

In the stopping procedure, line control valves 144 and 149 are shut off, the engine 12 is stopped and the electric switch SW1 is turned to the off position to prevent the burner from lighting. In the event the switch SW1 is not turned off and the line valve 144 is closed, heated water is forced back through the water line and the low temperature switch contact LPSW opens to disable the motor circuit.

As soon as the water valve 144 is shut off, the by-pass unloader valve 126 returns the line pressure to zero and the water is returned to the water tank 14 as above-described. Finally, the plug 99 is removed from the electric power source.

By way of illustration only and not by way of limitation there is listed below devices which have been found suitable for use in the illustrated apparatus:

| Device | Model No. | Manufacturer |
|---|---|---|
| By-pass unloader valve 126 | AA 133 | Spraying Systems Co. |
| Engine 12 | EY 44W (10.5 hp, 3600 rpm, 4 cycles) | Wisconsin Robbins |
| Air Compressor 13 | X-2 (20–80 psi) | Quincy |
| Pump 14 | 620 (1200 – 1600 psi) | Cat Pumps |
| Heating Unit 95 | Type No. 70-27A 49501 SN 27517195 | White-Rodgers |
| Flow Switch 135 | Type F6 IKD SPDT Switch | Penn |
| Low Temperature Control 123 | Aquastat No. L4006 E1000 | Honeywell |
| High Temperature Control 124 | Aquastat No. L4080 B1105 2 | Honeywell |

Although the present invention has been described with a certain degree of particularly, it is understood that the present disclosure has been made by way of example and that changes in details of structure may be made without departing from the spirit thereof.

What is claimed is:

1. A spray head operated by a fluid under pressure for spray cleaning a surface comprising:

a distributor body of a cleaning chemical corrosion-resistant material having a top surface and a front surface substantially normal to said top surface, said front surface and top surface meeting at a deflecting edge and having a discharge aperture in said top surface through which a jet of a cleaning chemical fluid is delivered under pressure; and spray nozzle means adjacent the distributor body having an inlet adapted to receive a supply of heated carrier fluid under pressure, said spray nozzle means having a tip located at the rear of and above the top surface of said distributor body and said discharge aperture for producing a substantially horizontal, generally planar, fan-like pattern of heated carrier fluid and directing said spray pattern at a slight angle to said top surface toward and against said deflecting edge whereby the jet of chemical cleaning fluid is emitted into the spray of heated carrier fluid prior to striking said deflecting edge and whereby the cleaning chemical fluid and heated carrier fluid are intimately mixed and the mixture is deflected from said edge as a mixed spray in a concentrated form that is directed toward a surface to be cleaned.

2. A spray head as set forth in claim 1 wherein said spray nozzle means is pivotally connected to said distributor body to adjust the angle between the spray nozzle and the top surface of the distributor body to direct the spray from the nozzle to said deflecting edge.

3. A spray head as set forth in claim 2 wherein said spray nozzle means includes a support body with a throughbore having one end forming an inlet and a spray nozzle with the orifice mounted on the outlet end of the throughbore, said support body having a projecting portion pivotally connected to a projecting portion in the distributor body.

4. A spray head as set forth in claim 3 wherein said top surface of said distributor body is slightly inwardly concave in shape.

5. A spray head as set forth in claim 1 wherein said distributor body is made of a corrosion resistant material selected from the group consisting of zirconium and titanium.

6. A spray head operated by separate supplies of heated water under pressure and a cleaning chemical fluid under pressure for spray cleaning a surface comprising:

a distributor body of generally oblong shape made of a corrosion resistant material having a top surface, opposed side wall surfaces and a front wall surface, said top and front wall surfaces meeting at a knife-like leading deflecting edge, said top surface being slightly inwardly concave and having a discharge aperture therein leading from a bore in said body arranged at substantially right angles to the top surface to direct a jet of cleaning chemical fluid away from said top surface, said distributor body having a lug portion projecting away from a rear wall surface thereof with an aperture and a flow line coupling in the body to couple cleaning chemical fluid to the bore;

a support body having a forked projecting portion extending forwardly of the front wall surface that slidably receives the lug portion and has a set of opposed apertures aligned with the apertures in said lug portion and a pivot member extending through said alined apertures to provide for relative pivotal movement between said distributor body and said support body, the rear wall surface of the distributor body and the front wall surface of the support body being oppositely disposed from one another, said support body having a throughbore passing through the front wall surface and a rear wall surface thereof with coupling means in the rear wall to couple a flow line carrying heated water under pressure thereto;

a spray nozzle mounted in the front wall of the support body and extending into the throughbore having a tip with a discharge orifice located to the rear and above the top surface of said distributor body and said discharge aperture for producing a generally planar, fan-like spray pattern of heated water and directing said spray pattern downwardly at a slight angle to said top surface toward and against said deflecting edge, said spray pattern being in a fan-like pattern that is confined approximately within the sidewall surfaces at said deflecting edge, whereby said jet of cleaning chemical fluid is emitted into the spray of heated water prior to the spray of heated water striking said deflecting edge and in a direction approximately normal to the direction of said spray from said nozzle and whereby the cleaning chemical fluid and heated water are intimately mixed and distributed and the mixture is deflected from said edge as a high velocity, concentrated mixed spray toward a surface to be cleaned.

* * * * *